US006785995B2

(12) United States Patent
Herzog et al.

(10) Patent No.: US 6,785,995 B2
(45) Date of Patent: Sep. 7, 2004

(54) FIREARM SAFETY SYSTEM

(75) Inventors: Raanan Herzog, D.N. Menashe (IL); Ziv Geva, Rehovot (IL); Ofer Leizerovich, Nes-Ziona (IL)

(73) Assignee: SPID 2002 Corp., Woodmere, NY (US)

( * ) Notice: Subject to any disclaimer, the term of this patent is extended or adjusted under 35 U.S.C. 154(b) by 0 days.

(21) Appl. No.: 10/364,831

(22) Filed: Feb. 11, 2003

(65) Prior Publication Data

US 2003/0163942 A1 Sep. 4, 2003

Related U.S. Application Data

(63) Continuation of application No. 10/300,861, filed on Nov. 20, 2002, now Pat. No. 6,718,679, which is a continuation of application No. 10/087,085, filed on Mar. 1, 2002, now Pat. No. 6,499,243.

(51) Int. Cl.[7] ..... F41A 17/54; F41A 17/46
(52) U.S. Cl. ..... 42/70.07; 42/70.06
(58) Field of Search ..... 42/70.07, 70.06, 42/70.01

(56) References Cited

U.S. PATENT DOCUMENTS 989,817 A * 4/1911 Siegel ..... 42/70.06
3,222,809 A * 12/1965 Bryan ..... 42/70.06
3,324,587 A * 6/1967 Bryan ..... 42/70.06
4,970,819 A * 11/1990 Mayhak ..... 42/70.01

* cited by examiner

*Primary Examiner*—Charles T. Jordan
*Assistant Examiner*—Bret Hayes
(74) *Attorney, Agent, or Firm*—Skadden, Arps, Slate, Meagher & Flom LLP

(57) ABSTRACT

A firearm safety system restricts the use of the firearm by reference to biometric data received by a sensor coupled to the firearm trigger. The biometric data is compared to at least one record of biometric data associated with a permitted user to determine whether firearm actuation is permitted. Firearm actuation is controlled by a latching track that is coupled to the firearm trigger. Firearm actuation is prevented when the latching track prevents the sliding of a ring rigidly coupled to the trigger. Firearm actuation is permitted when the latching track allows for the sliding of the ring past the predetermined location on the track.

3 Claims, 10 Drawing Sheets

FIREARM SAFETY SYSTEM

CROSS-REFERENCE TO RELATED APPLICATIONS

This application claims priority to and is a countinuation of U.S. application Ser. No. 10/300,861, entitled "Firearm Saftey System", filed on Nov. 20, 2002, now U.S. Pat No. 6,718,679. The present application is a countinuation of U.S. application Ser. No. 10,087,085, filed Mar. 1, 2002, now U.S. Pat. No. 6,499,243 B1, which is corporated by reference herein.

FIELD OF THE INVENTION

The present invention relates to firearm safety and, more particularly, to restricting the actuation of a firearm by reference to user biometric data.

BACKGROUND OF THE INVENTION

Gun safety is a paramount issue in today's society. Advocacy groups on both sides of the "Gun Control" issue support the development of devices which prevent unauthorized gun use. Such restrictions are commonly endorsed as means for preventing gun use by children and criminals. Accordingly, efforts have been made to incorporate firearms with devices, which restrict or control use.

Several devices have been developed to address this need for firearm safety devices. For instance, U.S. Pat. Nos. 4,467,545, 5,502,915, and 5,603,179 disclose gun safety devices, which use finger or hand print data in identifying authorized users and enabling operation. Similarly, U.S. Pat. Nos. 5,570,528, and 5,459,957 disclose gun safety devices, which use voice recognition circuitry for identifying authorized users and enabling operation.

Some of the above firearm safety devices operate on the firearm's safety latch, whereby the safety latch can only be disabled by an authorized user. However, the safety latch is an important element of a firearm, which allows an authorized user to disable the firearm so as to prevent accidental firing. Any modifications to the safety latch, which automatically disengage the latch on positive identification of the user, remove an essential feature of the firearm and are thus undesirable. Moreover, the safety latch is not an essential element of the firing mechanism, allowing for circumvention of the devices while an operational firearm remains.

Other existing systems utilize a magnet, or other electromechanical element coupled to the firing hammer to enable or disable firing of the gun. To utilize these prior art devices with existing guns, the guns must be disassembled to install the necessary hardware. Such disassembly, installation of the appropriate hardware, and reassembly of the gun may be difficult to accomplish, resulting in underutilization of the safety devices.

Therefore, there is a need for a firearm safety system that does not require disassembly of the firearm, does not tamper with the firearm safety latch, and controls the actuation of a firearm by reference to an essential element of the firing mechanism.

SUMMARY OF THE INVENTION

Therefore, in accordance with the present invention, a system for restricting use of a firearm is presented which does not require disassembly of the firearm and is targeted at disabling an essential element of the firing mechanism, namely the trigger, rather than the safety latch. The safety system further makes use of a person's fingerprint data, which is a unique personal property that is highly suitable for tracking and control.

In one embodiment, the invention provides a firearm safety system that includes a sensor coupled to the trigger of the firearm. The sensor including a reading surface and is adapted to receive biometric data by a user placing at least a portion of its finger on the reading surface of the sensor. The safety device also includes a latching track that has a latching mechanism electrically coupled to the sensor. The latching mechanism receives at least a control signal from the sensor to disengage the latching mechanism to an open position. The latching mechanism has a sliding ring rigidly coupled to the trigger of the firearm to prevent the displacement of the trigger when the sliding ring cannot move beyond the latching mechanism and to allow the displacement of the trigger when the sliding ring is allowed to move beyond the latching mechanism.

In another embodiment, the invention provides a firearm safety system that includes a sensing element coupled to the trigger of the firearm. The sensing element is adapted to receive biometric data by a user placing at least a portion of its finger on the sensing means. The safety system also includes a latching element electrically coupled to the sensing element. The latching means receives at least a control signal from the sensor to disengage the latching element to an open position. The sliding element is rigidly coupled to the trigger of the firearm to prevent the displacement of the trigger when the sliding element is limited by the latching element and to allow the displacement of the trigger when the sliding means is free of the latching element.

In yet another embodiment, the invention provides a firearm safety system that includes a biometric sensor coupled to the firearm trigger. The biometric sensor is adapted to receive biometric data from a user of the firearm and provide the biometric data to a processor unit. The system also includes a processor unit that is adapted to receive biometric data from the biometric sensor and compare the received biometric data to biometric data associated with at least one authorized user. The processor unit provides at least an enable signal to a sliding latch in response to a matching comparison of the data. The system also includes a sliding latch that has a latch rod and a ring slidably movable about the rod. The latch rod is rigidly coupled to the firearm. The sliding ring is at least rigidly coupled to the trigger latch rod to transfer lateral force to the trigger. The latch rod has a latching mechanism to prevent sliding of the ring beyond a predetermined point on the latch rod to control movement of the trigger by application of lateral force to the trigger.

DETAILED DESCRIPTION OF THE INVENTION

Figure 1:
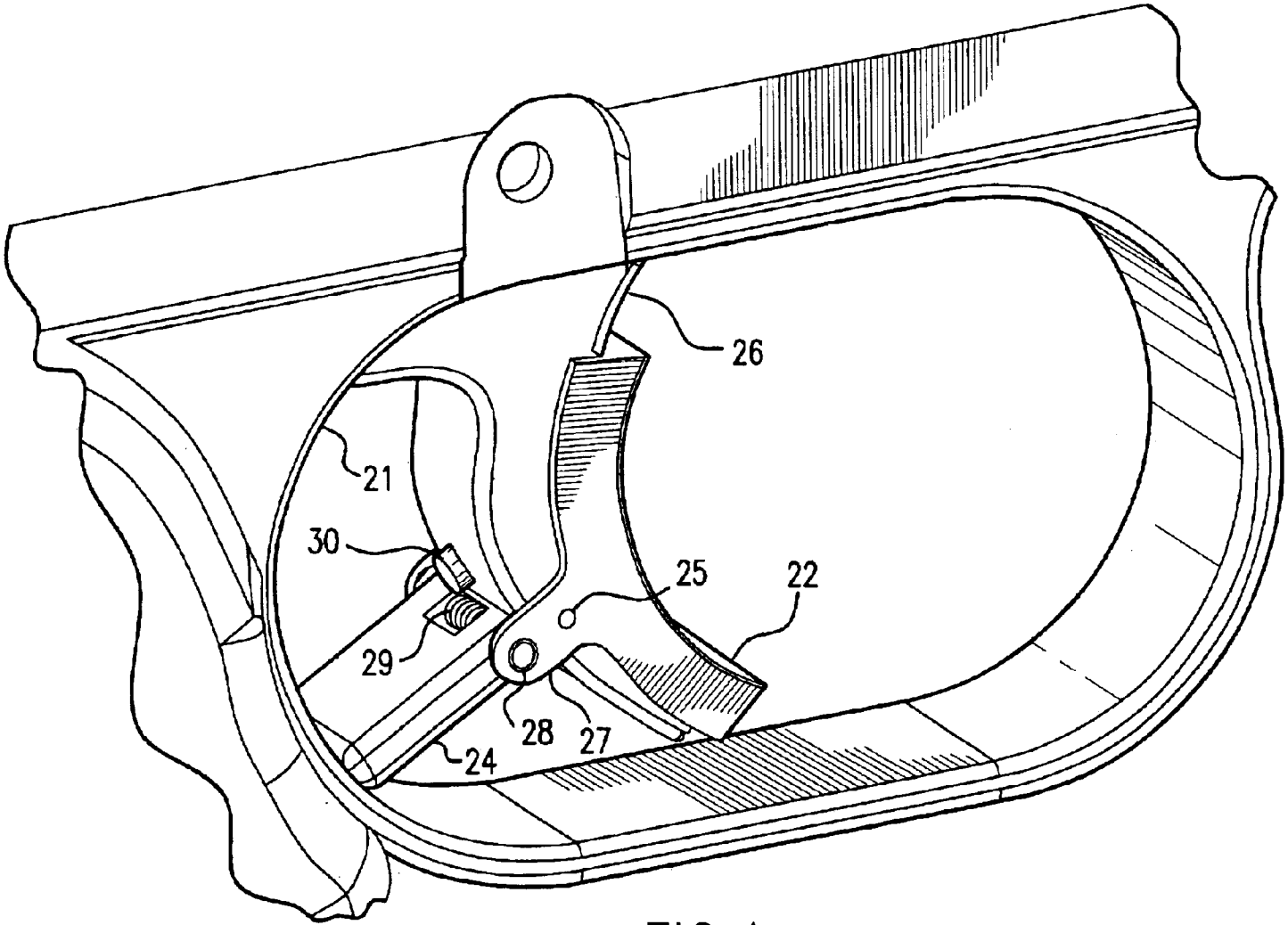
FIG. 1 illustrates a trigger aperture including a trigger that is fitted with a safety device in accordance with the invention.

FIG. 1 illustrates a trigger aperture 21 including a trigger 26, which is fitted with a safety device of the invention. The safety device is preferably coupled to the trigger 26 so as to prevent a displacement of the trigger, which results in an actuation of the firearm when the safety device is engaged in a locked position. The safety device includes a sensor housing 22 that is preferably mounted on the forward facing portion of the trigger 26. The sensor housing 22 is rigidly coupled to the trigger 26 by a pair of bolts 25, passing through the side of the sensor housing. Each bolt 25 advantageously includes a breakable head such that after the bolt is inserted to its final position, the bolt head is snapped off to prevent the removal of the bolt, and consequently, prevent the removal of the safety device. The sensor housing 22 is further pivotally coupled to an anchor 24.

The anchor 24 is pivotally coupled to the sensor housing 22 such that the anchor is provided in either an extended position, which prevents the actuation of the firearm, or in a retracted position, which allows for the actuation of the firearm. The anchor 24 is preferably positioned within the trigger aperture 21 of the gun so as to prevent the backwards movement of the trigger 26 by rigidly engaging the periphery of the trigger aperture when such movement is attempted. The anchor 24 is preferably coupled to the sensor housing connecting arms 27 by a pin 28 that is inserted through the edge of the anchor and the connecting arms. A spring 29 is preferably provided around the circumference of the pin to force the anchor 24 to a retracted position.

A latch is provided in a position extending from the sensor housing through the rearward facing portion of the trigger. In one embodiment, the latch is an electrically controlled solenoid. The solenoid center pin 30 is extended in the absence of an active signal at its input. When an active signal is received by the solenoid, the solenoid pin 30 is retracted. Accordingly, the retraction and extension of the solenoid pin 30 facilitates the operation of a latch, which controls the anchor's movement. In another embodiment, the latch is provided by an electromagnetic element, which extends from the rearward facing portion of the trigger 26 substantially parallel to a magnetic portion of the anchor 24. The electromagnetic element is controlled so as to maintain the anchor 24 is an extended position until it receives an active signal at an input.

In operation, when the latch is in the locked position, the solenoid pin 30 maintains the anchor 24 extended away from the trigger 26 substantially perpendicular to the longitudinal axis of the trigger so as to restrict the actuation of the firearm. To facilitate the locking, the solenoid pin 30 is extended in contact with the anchor substantially perpendicular to the anchor 24. When an authorized user is detected by the sensor 23, an active signal is provided to the solenoid. The solenoid pin 30 is then retracted to allow the anchor 24 to move to the retracted position, substantially parallel to the longitudinal axis of the trigger 26, thus allowing for the actuation of the firearm.

Figure 2:
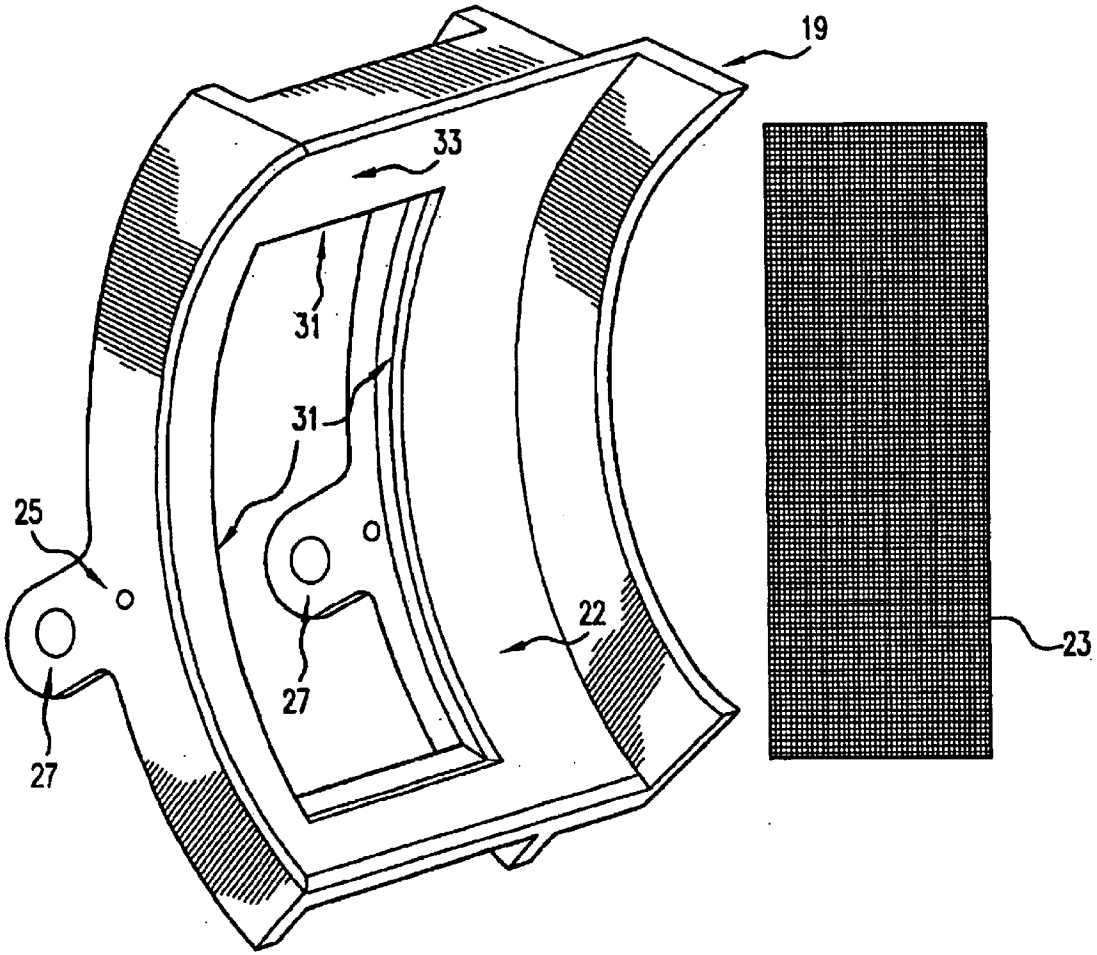
FIG. 2 illustrates the sensor housing of the safety device of FIG. 1.

FIG. 2 illustrates the sensor housing of the safety device of FIG. 1. The sensor housing 22 preferably includes a stopper flange 19 that ensures that a user's finger is provided in a consistent position along the sensor's input portion. The location (left or right) and position of the stopper flange 19 are preferably adjustable according to user convenience. The sensor housing 22 is adapted to retain a sensor 23 in a central cavity portion 31. The sensor housing 22 includes a portion 33 adapted to contain a battery, which provides power to the electronic components of the safety device. The sensor housing 22 further includes a pair of connecting arms 27 to pivotally couple to the anchor 24 by a connecting pin that is inserted through the connecting arms and the anchor.

The sensor 23 preferably provides an active signal in response to detecting biometric data that is associated with an authorized user. The biometric data is derived by sensing characteristics of a user's fingerprint. In one embodiment, the sensor 23 is an optical sensor that senses an optical image of the fingerprint. In another embodiment, the sensor 23 is a semiconductor sensor that senses data derived by measuring capacitances associated with contours of the user's fingerprint. The sensor signal resulting from a positive comparison of biometric data is preferably provided to the electromechanical latch, which controls the movement of the anchor 24. The sensor 23 is preferably a solid-state, silicone-based capacitive Fingerprint sensor from Veridicom Inc. of Sunnyvale, Calif. In the illustrated embodiment, the sensor 23 includes internal memory and comparison circuit, which is used to determine whether the received biometric data is associated with an authorized user.

In one embodiment, the sensor 23 compares the received biometric data to a single record of biometric data that is internally stored in local memory (not shown). In another embodiment, discussed with reference to FIG. 7, the sensor 23 compares the received biometric data to several records of data, which are stored in a memory module. The comparison of biometric data is preferably preformed by a comparator circuit (not shown) which is associated with the sensor 23. In one embodiment, the comparator circuit generates a match criteria score for received biometric data. When the match criteria score is beyond a predetermined threshold, a positive match signal is provided by the comparator circuit. In one embodiment, the matching criteria is provided as a percent match threshold level, which in part depends on the quality of components in the safety device. For example, when employing a high resolution sensor, the matching criteria may be increased from that used when employing a low resolution sensor.

Figure 3:
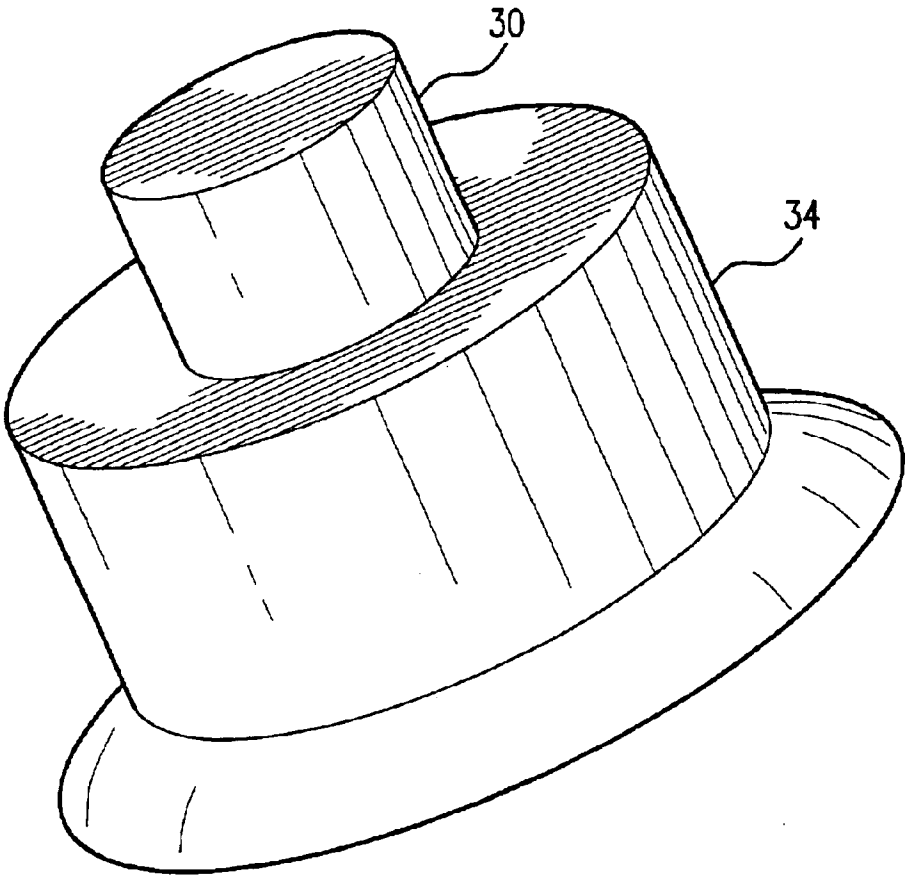
FIG. 3 illustrates the solenoid of the safety device of FIG. 1.

FIG. 3 illustrates the solenoid of the safety device of FIG. 1. The solenoid 34 includes a pin that is retracted by the activation of the solenoid, as is known in the art. The solenoid 34 preferably further includes a mechanism (not shown) for returning the pin 30 to an extended position.

Figure 4:
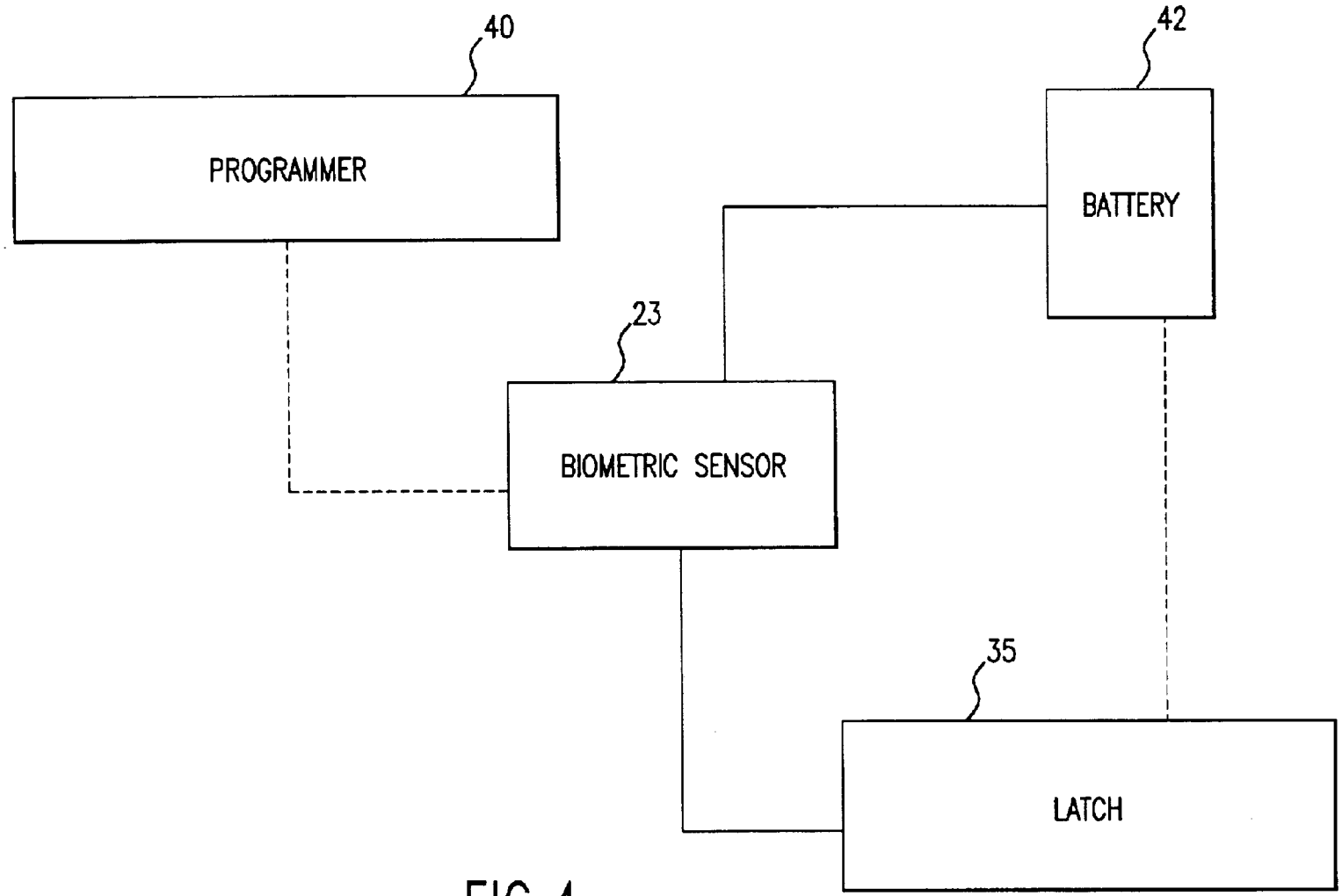
FIG. 4 illustrates the logical components associated with an embodiment of a safety device of the invention.

FIG. 4 illustrates a logical configuration of elements in a safety device of the invention. The safety device includes a sensor element 23 that is electrically coupled to a battery 42 and a latch 35. The battery 42 provides power to the sensor element to allow for comparing received biometric data to stored biometric data and for generating an active signal in response to positive comparison. As discussed above, the sensor element 23 includes a comparison circuit and a memory to store at least one biometric data record. The latch 35 is electronically controlled by the sensor so as to allow for retracting the anchor 24 in response to an active signal from the sensor. In one embodiment, the active signal also provides the power required to disengage the latch 35. In another embodiment, the latch 35 receives power by a direct connection to the battery 42.

A programmer unit 40 is preferably removably coupled to the sensor 23 to control the sensor during a programming mode of the safety device. During the programming mode, the sensor 23 receives biometric data associated with at least one authorized user. The received biometric data is stored by the sensor 23 in an internal memory (not shown). During an operating mode, the sensor 23 receives biometric data, which is compared to the stored data in the internal memory so as to control access to the firearm actuation mechanism.

Figure 5:
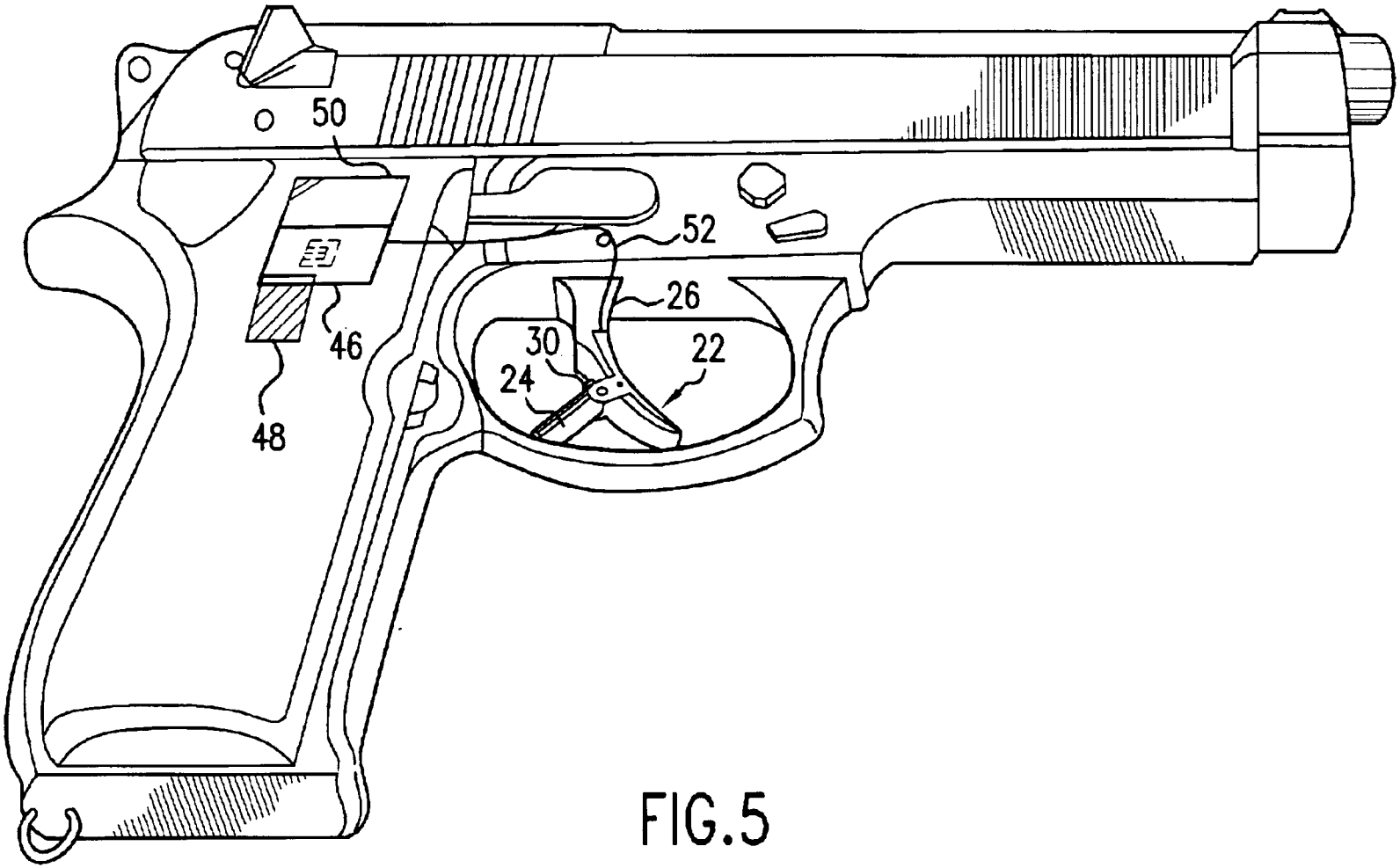
FIG. 5 illustrates a firearm that is fitted with a safety device in accordance with an alternate embodiment of the invention.

FIG. 5 illustrates an alternate arrangement of a safety device of the invention. The safety device of FIG. 5 includes a reading module 46, in addition to the elements of the safety device of FIG. 1, which receives a memory card 50, storing biometric data for at least one authorized user. The reading module 46 is preferably coupled to the firearm's butt portion. The reading module is preferably coupled to the sensor housing 22 by a communication wire 52. In one embodiment, the communication wire 52 includes a fiber optic cable. In another embodiment, the communication wire 52 includes a plurality of wires associated with data and power lines.

In one embodiment, the reading module 46 is adapted to receive a programmable "smartcard" 50. The card 50 preferably includes a memory chip that is adapted to store data. In another embodiment, the card 50 is a processor card that includes both memory and a processor to facilitate the search and comparison algorithms employed by a device in accordance with the invention. Such smart-cards are available from GEMPLUS of Senningerberg, Luxembourg.

The card 50 is preferably programmed by an external biometric data programmer. Such programmers are available from Veridicom of Sunnyvale, Calif. The sensor 23 employs the data stored in the card to determine whether received biometric data is associated with an authorized user. The sensor 23 preferably retrieves biometric data stored in the card 50 and provides each such data record to a comparison circuit operating in accordance with a predetermined matching criteria. In the illustrated embodiment, an external circuit 48 is provided to retrieve and compare data from the card 50.

Figure 6:
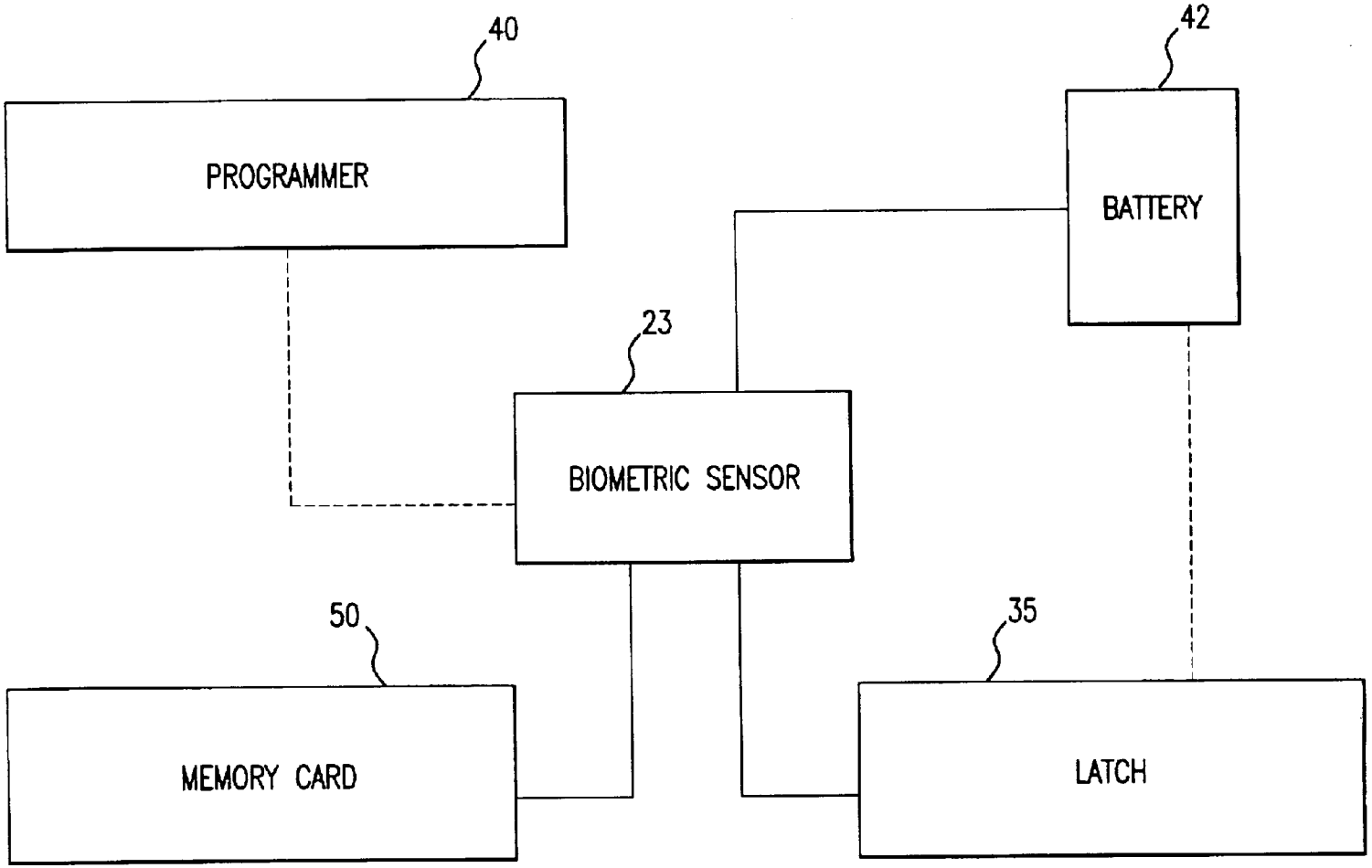
FIG. 6 illustrates the logical components associated the safety device of FIG. 5.

FIG. 6 illustrates the logical arrangement of components in the safety device of FIG. 5. The sensor 23 is coupled to a battery to provide power for the sensor's operation. The sensor 23 is further coupled to the control port of a latch 35. The control signal to the latch 35 preferably includes power required by the latch for executing the requested operation. The sensor 23 is further coupled to the memory card 50 for retrieving biometric data associated with authorized users. In one embodiment, the card 50 carries biometric data for a single user that intends to use the firearm. Thus, the user can employ different firearms by replacing the card associated with the user's biometric data in the desired firearm. In one embodiment, an external programmer 40 is removably coupled to the sensor to allow for storing biometric data in the card by employing the sensor as a data reception device.

Figure 7:
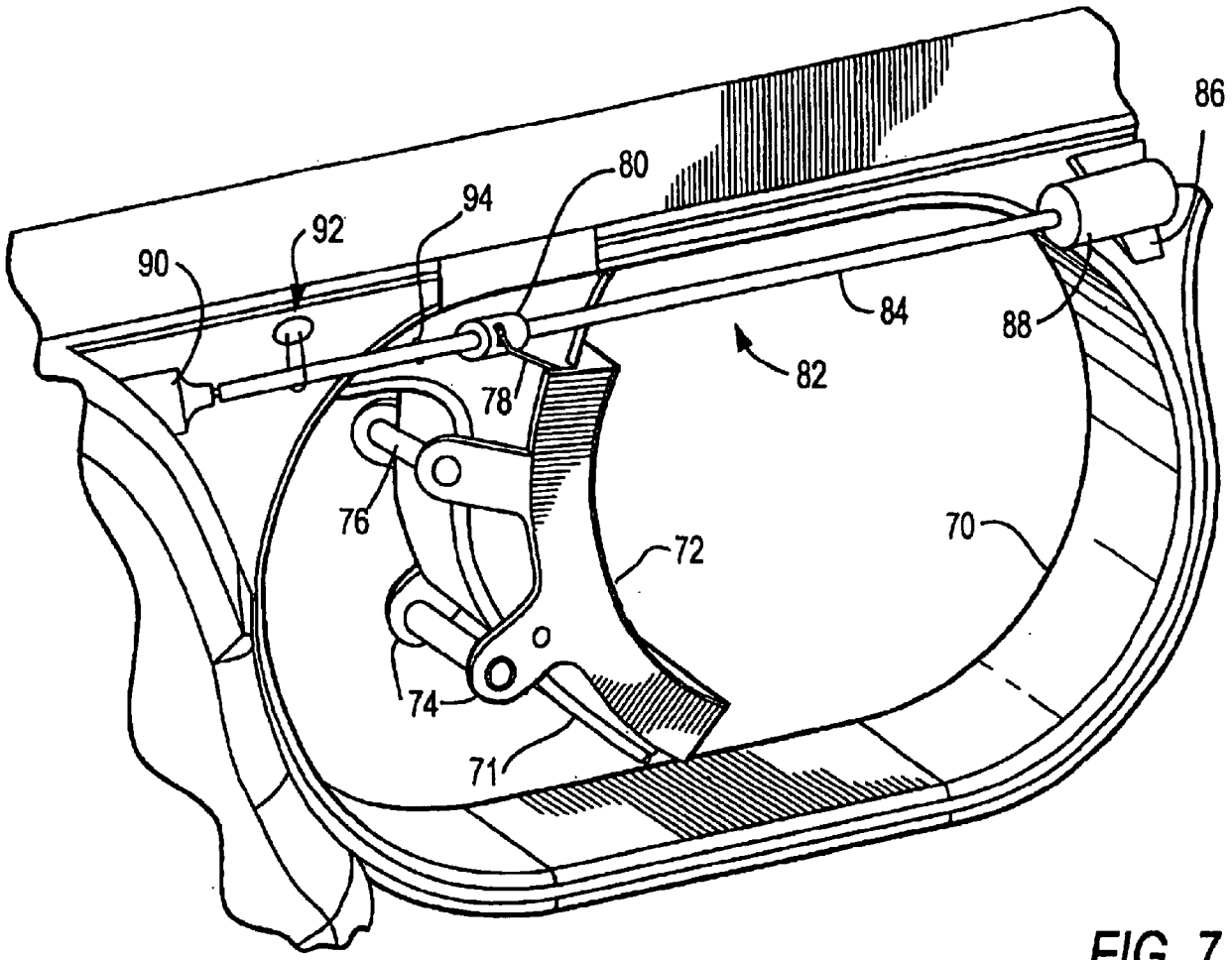
FIG. 7 illustrates an alternate embodiment of a safety device of the invention.

FIG. 7 illustrates an alternate embodiment of the safety device of the present invention. In the embodiment of FIG. 7, the trigger anchoring is generally facilitated by a combination of a connecting rod 78 and a track having a latching mechanism 82. As in the embodiments discussed above, the biometric sensor is provided within a sensor housing 72 and is coupled to the firearm actuation mechanism, or trigger 71. In the embodiment of FIG. 7, the sensor housing is coupled to the trigger by a pair of coupling arms 74 extending from the periphery of the sensor housing 72. A securing pin 76 is used to connect the coupling arms 74 so as to form an enveloping structure around the trigger 71, thereby securing the sensor housing 72 to the trigger. In other embodiments the coupling arms 74 are coupled together by a screw, preferably with a breakable security head. In the illustrated embodiment, two sets of coupling arms 74 and securing pins 76 are used to couple the sensor housing 72 to the trigger 71. As may be appreciated, in other embodiments, a different number of such coupling arms 74 and pins 76 are used to couple the sensor housing 72 to the trigger 71.

The sensor circuitry, which is contained within the sensor housing 72, is preferably electrically coupled to a microprocessor and associated memory by a communication cable (not shown). In one embodiment, the cable, microprocessor, and memory are the same as those discussed by reference to FIG. 5.

A latching track 82 is coupled to the sensor housing 72 by a connecting rod 78. The connecting rod 78 is preferably coupled to a sliding ring 80, which is adapted to move along the latching track 82. In one embodiment, the sliding ring 80 does not fully envelope the latching track 82 but only partially circumscribes the latching track 82. The latching track 82 preferably includes a latch rod 84 and a latching mechanism 94. The latch rod 84 is preferably hollow so as to allow for retaining a control bar associated with the latching mechanism 94. A front support 86 is used to couple a first end of the latching track 82 to the firearm body. In one embodiment, the front support 86 couples the latching track 82 to a flat surface adjacent to the upper forward portion of the trigger aperture 70. A rear support 90 is used to couple a second end of the latching track 82 to the firearm body. In one embodiment, the rear support 90 couples the latching track 82 to a flat surface adjacent to the upper rear portion of the trigger aperture 70. In one embodiment, a median support 92 is used to provide additional retaining strength on a medial point along the latching track 82. In the illustrated embodiment, the median support 92 is provided between the rear support 90 and the latching mechanism 94. The median support 92 is preferably not employed when other means secure the latching track 82 to the firearm so as to withstand a satisfactory level of force or other disturbances.

Figure 8:
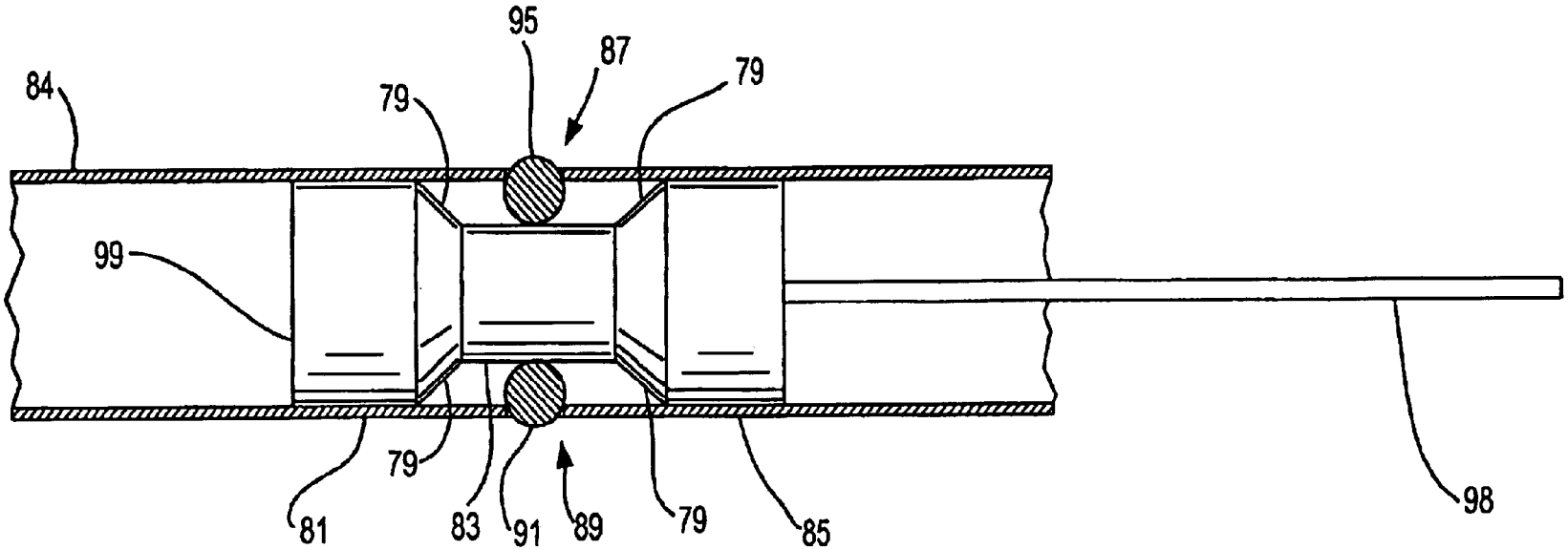
FIG. 8 illustrates details of a locking mechanism of the safety device of FIG. 7.

A motor housing 88 is used to couple the front support 86 to the latch rod 84 of the latching track 82. In an alternate embodiment, the motor housing 88 is coupled to the rear support 90. The motor housing 88 contains a motor (not shown) which is coupled to a control bar (FIG. 8). The control bar extends along an inner channel provided by the latch rod 84. The motor is preferably adapted to control the longitudinal movement of the control bar so as to operate the latching mechanism. In one embodiment the motor is an electric motor. In another embodiment, the motor is a pneumatic valve. A control cable (not shown) is preferably used to electrically couple the motor to the microprocessor so as to transmit electrical signals used to control the motor. The latching mechanism 94 preferably includes a pair of protrusions that are controlled to either retract within, or extend out from, the surface of the latch rod 84. The location of the latching mechanism 94 along the latch rod is preferably determined by reference to trigger and aperture dimensions of the particular firearm. Accordingly, different kinds of firearms will usually require different positioning of the latch mechanism 94 as well as different positioning of the latching track 82 and sensor housing. The firearm aperture in the illustration of FIG. 7 is of a 9 mm BERETTA 92F. Specific details of the latching mechanism 94 and its operation are provided below with reference to FIG. 8. In one embodiment, the latching track 82 is partially contained within a cover so as to prevent potential tampering with the safety device.

FIG. 8 illustrates the latching mechanism of the latching track of FIG. 7. The latching mechanism includes the control bar 98, a latch actuator 99, and a pair of bearings 91, 95. Each bearing 91, 95 is preferably seated inside the latch rod, within the latch actuator 99, adjacent to a corresponding opening 89, 87 on the latch rod exterior. The bearings 91, 95 are preferably smooth steel bearing such as those available from KEYSTONE. The diameter of the exterior openings 87, 89 is preferably smaller than the diameters 91, 95 of the corresponding bearings 91, 95 so as to prevent ejection of the bearings through the openings. In the illustrated embodiment, two circumferentially opposing opening 87, 89 for two bearings are employed. However, as may be appreciated varying number of bearings 91, 95 and bearing opening placements may be employed without deviating from the teachings of the invention. In one embodiment, the bearings 91, 95 are painted with a fluorescent color so as to allow for an observer to easily notice the bearings when partially extended through the openings 87, 89 under limited lighting conditions, such as during nighttime.

The latch actuator 99 includes a narrow mid-section 83 and a pair of wide end-sections 81, 85. The actuator mid-section 83 is preferably adapted to at least allow for each bearing 95, 91 to retract within the latch rod 84 without hindering the movement of the sliding ring 80. In one embodiment, the radius of the actuator mid-section 83 is greater than the difference between the Internal radius of the latch rod 84 and the diameter of the bearings but smaller than the difference between the external radius of the latch rod 84 and the diameter of the bearings. The actuator end-sections 81, 85 are preferably adapted to at least force each bearing 91, 95 to extend out from its corresponding opening 89, 87 so as to prevent the movement of the sliding ring 80 past the bearing. In one embodiment, the radius of the actuator end-sections 81, 85 is provided by reference to the diameter of the openings 87, 89. The diameter of the openings 87, 89 dictates the depth by which the bearings 91, 95 extend out and therefore provide for the level of clearance required between the inner wall of the latch rod 84 and the actuator end sections 81, 85. As may be appreciated, the openings' diameter is less than the bearings' diameter.

Transition sections of the latch actuator 79, provided between the mid-section 83 and each end-section 81, 85, are preferably angled from the mid-section to the end-sections and an obtuse angle to allow for the bearings 91, 95 to efficiently roll onto the exterior of the end-sections. In one embodiment, the angle of the transition sections 79 is determined by reference to the mechanism employed to control the movement of the control rod 98 (discussed below). The shape and angle of the transition sections 79 dictates the required moment and maximum speed under which the latch actuator operates. Specifically, the angle of the transition sections 79 dictates the torque required from the element that facilitates the movement of the control rod 98. The transition section angle also affects the latching speed or latching cycle provided by the latch actuator 99. As may be appreciated the slope of the transition sections 79 may be non linear such as a parabolic or other non linear shape, which may provide the most suitable characteristics for a particular electro mechanic element used to displace the control rod 98. The control rod 98 is rigidly coupled to the center of one of the actuator end-sections 81, 85. In one embodiment, where the motor is provided on the forward portion of the trigger aperture 30, the control rod 98 is coupled to the actuator end-section facing the forward portion of the trigger aperture.

The control rod 98 is movable along the longitudinal axis of the latch rod 84. This movement is preferably facilitated by the operation of the motor, under control of the microprocessor. The control rod movement causes a corresponding displacement of the latch actuator 99, along the longitudinal axis of the latch rod 84. In a first state, the displacement results in the latch actuator mid-section 83 positioned under the bearings 91, 95. In this first state, the bearings 91, 95 are retracted toward the center of the latch rod 84 so as to allow for movement of the sliding ring 80 past the bearings. In a second state, the displacement results in one of the latch actuator end-sections 81, 85 positioned under the bearings 91, 95. As may be appreciated, the bearings 91, 95 do not move with the latch actuator mid-section 83 since the opening created by the mid section is smaller than the diameter of the bearings. Therefore, the bearings 91, 95 remain aligned with the corresponding openings and are pushed out by the actuator end-section 81, 85, which is positioned under the bearings. The extended bearings 91, 95 thereby prevent the sliding ring 80 from moving beyond the latching mechanism 94.

Figure 9:
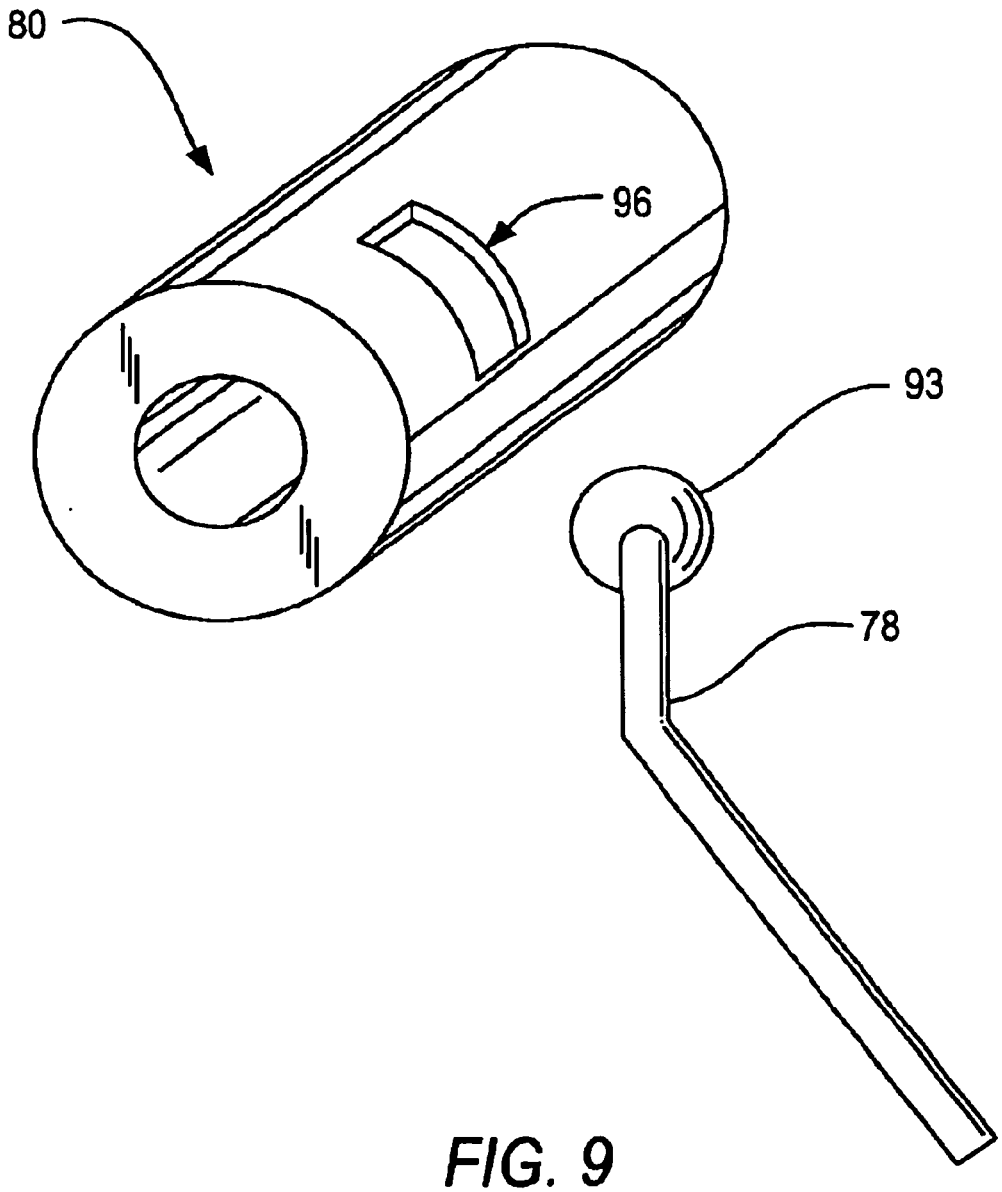
FIG. 9 illustrates a sliding ring and connection rod of the safety device of FIG. 7.

FIG. 9 illustrates further details of the sliding ring 80 and connecting rod 78 of FIG. 7. The sliding ring 80 includes a cross sectional slotted opening 96, adapted to receive a narrow portion of the connecting rod 78. A head portion of the connecting rod 93, illustrated as a spherical end element, is preferably introduced into such that the connecting rod narrow portion extends out of the slotted opening 96. The slotted opening 96 allows for at least the longitudinal movement of the connecting rod 78 while resisting lateral movement of the connecting rod so as to cause the sliding ring 80 to move about the latch rod 84 in response to lateral force, which is applied to the sliding ring by the connecting rod.

Referring to FIGS. 7, 8, and 9, in operation, in the absence of an authorized user, the microprocessor controls the motor so as to displace the control rod 98 to a position which results in the second state discussed above with respect to FIG. 8. In this state, the sliding ring 80 is prevented from moving past the extended bearings 91, 95. The trigger 71 is coupled to the sliding ring 80 by the connecting rod 78. In one embodiment, the connecting rod 78 is formed as part of the sensor housing so as to provide rigid coupling to the trigger, preventing possible tempering with the device by breaking away the connecting rod 78. Thereby, the movement of the trigger 71 is limited to movement that does not cause the sliding ring 80 to move past the extended bearings 91, 95.

A user attempts to gain access to the firearm by positioning a finger on the sensor. The sensor generates biometric data by reference to biometric features of the potential user. The biometric data is provided to the microprocessor by the communication cable. The microprocessor determines whether the biometric data is associated with an authorized user. If the user is not authorized, the microprocessor does not generate any signals. If the user is authorized, the microprocessor transmits a signal to the motor indicating that the control rod 98 should be moved to a second position. The motor responds by displacing the control rod 98 to a second position which preferably results in the first state discussed above with respect to FIG. 8. The sliding ring 80 can now move along the latch rod 84 past the bearings 91, 95, which are now retracted. The trigger 71 is thereby allowed to actuate the firearm by the sliding ring 80 moving to a position beyond the latching mechanism 94.

In another embodiment, the anchoring system of FIG. 7 is provided outside the bottom portion of the trigger aperture 30 while the connecting rod 78 between the sensor housing 72 and the sliding ring 80 is provided on the bottom portion of the sensor housing. This configuration may be required for various reasons including user convenience and firearm configuration. In yet another embodiment, the safety system of the invention is adapted as part of a newly manufactured firearm whereby the above discussed components are internally positioned within the firearm, as may be apparent to a person of ordinary skill in the art.

Figure 10:
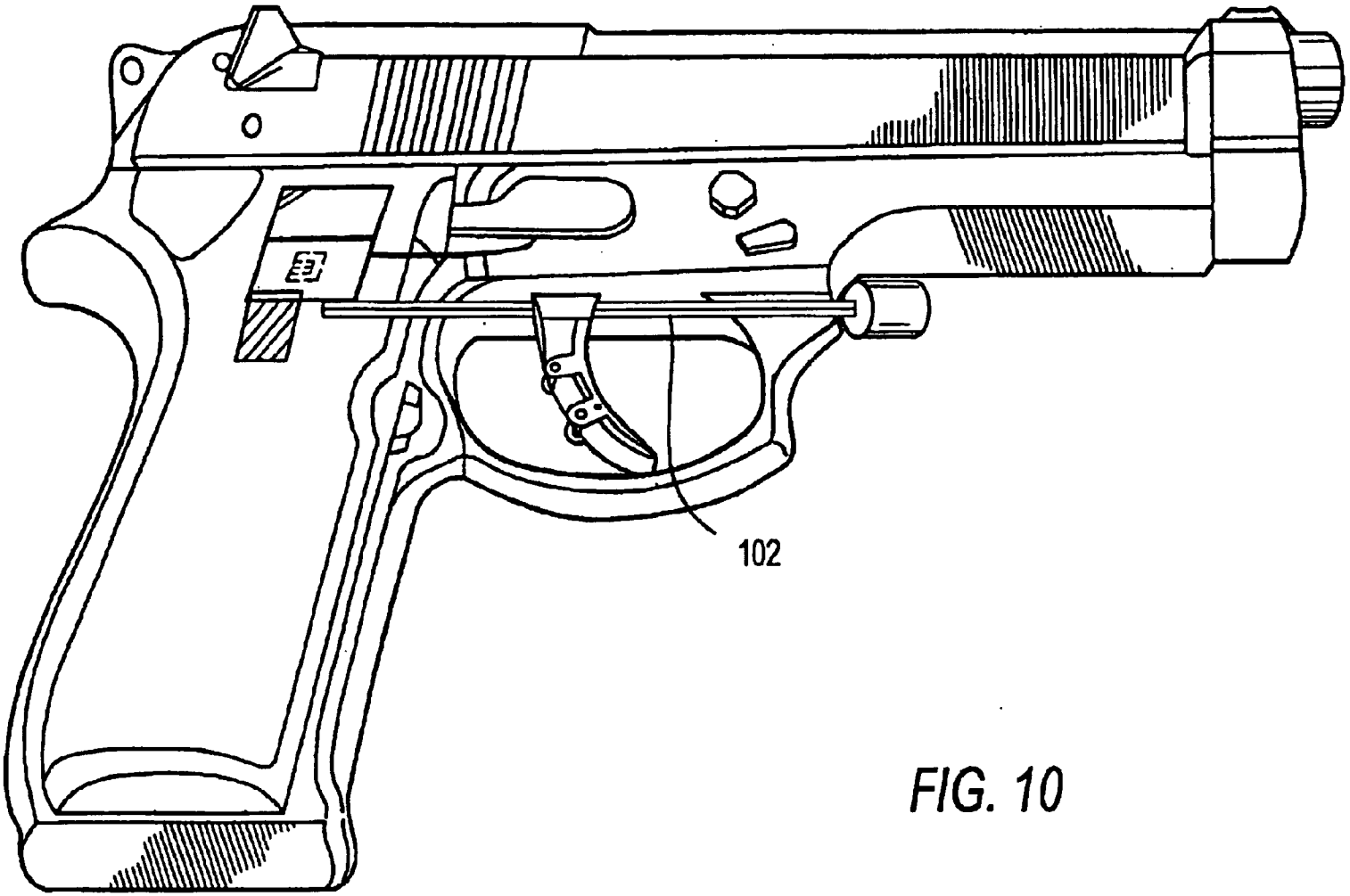
FIG. 10 illustrates an alternate embodiment of the safety device of FIG. 7, employing a rectangular sliding track.

FIG. 10 illustrates an embodiment of the safety system, which employs a latch rod 102 with a combined rectangular and circular cross sections. Details of this latch rod 102 are illustrated in the lower right portion of FIG. 10. The latch rod 102 includes a lower rectangular cross section channel and an upper circular cross section channel, which are coupled together at a flat portion of the circular cross section channel. The latch rod 102 extends from the motor to the processor to allow for containing communication wires which couple the motor of the latching mechanism to the processor. In this embodiment, the sliding ring 80 does not fully envelope the latch rod 102 but rather slides on the circular channel by a clamp-like retaining structure, as discussed above.

A person of ordinary skill in the art will appreciate that numerous variations and combinations of the features set forth above can be utilized without departing from the present invention as set forth in the claims. Thus, the scope of the invention should not be limited by the preceding description but should be ascertained by reference to claims that follow.

What is claimed is:

1. A firearm safety system, the firearm including a trigger, comprising:

a sensor coupled to the trigger of the firearm, the sensor including a reading surface, the sensor receiving biometric data by a user placing at least a portion of a finger on the reading surface of the sensor; and a latching track having a latching mechanism electrically coupled to the sensor, the latching mechanism receiving at least a control signal from the sensor to disengage the latching mechanism to an open position and further having a sliding ring rigidly coupled to the trigger of the firearm to prevent the displacement of the trigger when the sliding ring cannot move beyond the latching mechanism and to allow a displacement of the trigger when the sliding ring is allowed to move beyond the latching mechanism.

2. A firearm safety system, the firearm including a trigger, comprising:

sensing means coupled to the trigger of the firearm, the sensing means receiving biometric data by a user placing at least a portion of a finger on the sensing means;

latching means electrically coupled to the sensing means, the latching means receiving at least a control signal from the sensor to disengage the latching means to an open position; and sliding means rigidly coupled to the trigger of the firearm to prevent the displacement of the trigger when the sliding means is limited by the latching means to allow a displacement of the trigger when the sliding means is free of the latching means.

3. A firearm safety system, comprising:

a biometric sensor coupled to the firearm trigger, the biometric sensor receiving biometric data from a user of the firearm and provide the biometric data to a processor unit;

a processor unit adapted to receive biometric data from the biometric sensor and adapted to compare the received biometric data to biometric data associated with at least one authorized user, the processor unit providing at least an enable signal to a sliding latch in response to a matching comparison of said data;

a sliding latch including a latch rod and a ring slidably movable about the rod, the latch rod rigidly coupled to the firearm, the sliding ring at least rigidly coupled to the latch rod to transfer lateral force to the trigger, the latch rod including a latching mechanism to prevent sliding of the ring beyond a predetermined point on the latch rod to control movement of said trigger by application of lateral force to the trigger.

* * * * *